US009282876B2

(12) United States Patent
Benda et al.

(10) Patent No.: US 9,282,876 B2
(45) Date of Patent: Mar. 15, 2016

(54) DOSING SYSTEM FOR A DISHWASHER MACHINE

(71) Applicant: Henkel AG & Co. KGaA, Duesseldorf (DE)

(72) Inventors: Konstantin Benda, Duesseldorf (DE); Thorsten Bastigkeit, Wuppertal (DE); Arnd Kessler, Monheim am Rhein (DE); Salvatore Fileccia, Oberhousen (DE); Christian Nitsch, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/031,204

(22) Filed: Sep. 19, 2013

(65) Prior Publication Data

US 2014/0084024 A1 Mar. 27, 2014

Related U.S. Application Data

(63) Continuation of application No. PCT/EP2011/067789, filed on Oct. 12, 2011.

(30) Foreign Application Priority Data

Mar. 23, 2011 (DE) ..... 10 2011 005 979

(51) Int. Cl.
*A47L 15/44* (2006.01)
*A47L 15/00* (2006.01)

(52) U.S. Cl.
CPC ..... *A47L 15/4445* (2013.01); *A47L 15/006* (2013.01); *A47L 15/4454* (2013.01); *A47L 15/4463* (2013.01); *A47L 15/4472* (2013.01); *A47L 2401/10* (2013.01); *A47L 2401/12* (2013.01); *A47L 2401/30* (2013.01); *A47L 2401/32* (2013.01); *A47L 2501/07* (2013.01)

(58) Field of Classification Search
USPC ..... 222/113, 325, 129
See application file for complete search history.

(56) References Cited

U.S. PATENT DOCUMENTS

| | | | | |
|---|---|---|---|---|
| 6,095,370 | A * | 8/2000 | Rhine et al. | 222/1 |
| 8,631,972 | B2 * | 1/2014 | Kessler et al. | 222/129 |
| 2002/0088502 | A1 | 7/2002 | Van Rompuy et al. | |

(Continued)

FOREIGN PATENT DOCUMENTS

| | | | |
|---|---|---|---|
| WO | 2010/007051 | A2 | 1/2010 |
| WO | 2010/094386 | A1 | 8/2010 |
| WO | WO 2010094386 | A1 * | 8/2010 |

OTHER PUBLICATIONS

PCT International Search Report (PCT/EP2011/067789) dated Aug. 2, 2012.

*Primary Examiner* — Donnell Long
(74) *Attorney, Agent, or Firm* — Thomas G. Krivulka

(57) ABSTRACT

The invention relates to a dispensing system (1) for delivering at least one cleaning-agent preparation (A, B, C) into the interior of an automatic dishwasher, encompassing a dispenser (2) having a light source (4), and a cartridge (3) couplable to the dispenser (2), in which cartridge at least one flowable preparation (A, B, C) is stocked; the cartridge (3) has a width (b) to depth (t) ratio from 3:1 to 20:1 and the cartridge (3) has a height (h) to depth (t) ratio from 3:1 to 20:1, and the walls of the cartridge (3) have, at least locally, a transmittance from 75% to 99% in the wavelength region between 700 nm and 1 mm; the flowable preparation (A, B, C) has a transmittance from 75% to 99% in the wavelength region between 700 nm and 1 mm.

8 Claims, 1 Drawing Sheet

(56) References Cited

U.S. PATENT DOCUMENTS

2009/0235962 A1 9/2009 Classen et al.
2010/0161143 A1* 6/2010 Smith et al. ..... 700/283
2011/0174341 A1 7/2011 Kessler et al.
2011/0204096 A1* 8/2011 Kessler et al. ..... 222/372

* cited by examiner

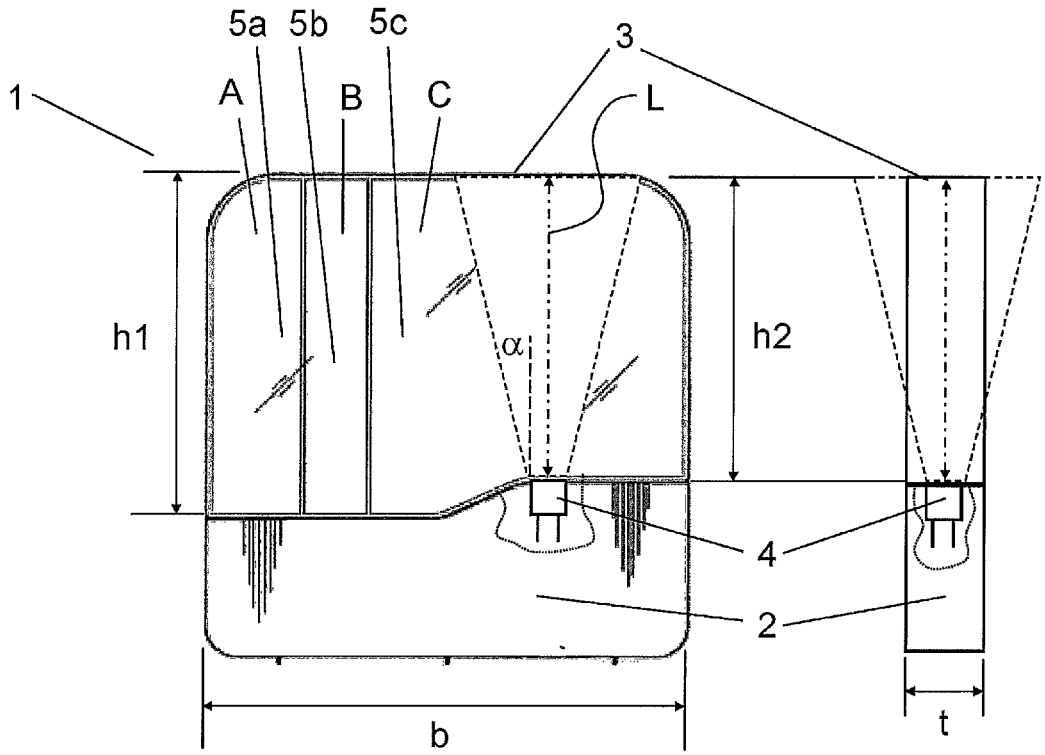
5a
5b
5c
3
1
A
B
C
L
h1
h2
α
4
2
b
t

DOSING SYSTEM FOR A DISHWASHER MACHINE

FIELD OF THE INVENTION

The present invention generally relates to a dispensing system for an automatic dishwasher having optical communication between the dispensing system and the automatic dishwasher.

BACKGROUND OF THE INVENTION

Automatic dishwashing and washing agents are available to consumers in a large number of presentation forms. These automatic dishwashing and washing agents are offered to the consumer typically in solid form, for example as powders or tablets, but increasingly also in liquid or gel form. Emphasis has for some time been placed principally on convenient dispensing of dishwashing and washing agents, and on simplification of the working steps necessary for carrying out a dishwashing or washing method.

Furthermore, one of the main objectives of manufacturers of automatic dishwashing and washing agents is to improve the cleaning performance of these agents, increased emphasis recently having been placed on cleaning performance in low-temperature cleaning cycles such as in cleaning cycles having reduced water consumption. To this end, new ingredients, for example more-effective surfactants, polymers, enzymes or bleaching agents, have preferably been added to the dishwashing and washing agents. Because new ingredients are available only to a limited extent, however, and because for environmental and economic reasons the quantity of the ingredients used for each washing cycle cannot be arbitrarily increased, there are natural limits to this approach to a solution.

In this connection, apparatuses for multiple dispensing of dishwashing and washing agents have very recently come under scrutiny by product developers. With regard to these apparatuses, a distinction may be made between on the one hand dispensing systems integrated into dishwashers, and on the other hand separate devices functioning substantially independently of the dishwasher. By means of these dispensing systems, which contain several times the quantity of dishwashing and washing agent required to carry out a treatment cycle, dishwashing- and washing-agent portions are automatically or semi-automatically dispensed into the interior of the water-conveying household system in the course of multiple successive treatment programs. For the consumer, the need for manual dispensing for each treatment cycle is eliminated. Examples of such apparatuses are described in European patent application EP 1 759 624 A2 (Reckitt Benckiser) or in German patent application DE 53 5005 062 479 A1 (BSH Bosch and Siemens Hausgeräte GmbH). It is advantageous in particular to equip such dispensers with a communication apparatus that permits data exchange between the dispenser and the control device of the automatic dishwasher. Besides radio transmission apparatuses, apparatuses for the optical transmission of signals and data are also known in this context from the existing art. Examples of such dispensing systems are found in US 2002/0088502A1 (Procter & Gamble) or EP2299892 (Henkel AG & Co KGaA).

Signal shadowing and signal screening represent a problem for all dispensing apparatuses known from the existing art for automatic dishwashers having wireless signal transmission. This problem has not yet been solved in satisfactory fashion.

The object of the invention is consequently that of overcoming the problems known from the existing art, and improving optical communication between a dispenser positionable in the automatic dishwasher and the automatic dishwasher.

This object is achieved by a dispensing system having the features of Claim 1.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A dispensing system (1) for delivering at least one cleaning-agent preparation (A, B, C) into the interior of an automatic dishwasher, encompassing a dispenser (2) having a light source (4), and a cartridge (3) couplable to the dispenser (2), in which cartridge at least one flowable preparation (A, B, C) is stocked, wherein the cartridge (3) has a width (b) to depth (t) ratio from 3:1 to 20:1; and the cartridge (3) has a height (h) to depth (t) ratio from 3:1 to 20:1; and the walls of the cartridge (3) have, at least locally, a transmittance from 75% to 99% in the wavelength region between 700 nm and 1 mm, preferably 700 nm to 1000 nm; the flowable preparation (A, B, C) has a transmittance from 75% to 99% in the wavelength region between 700 nm and 1 mm, preferably 700 nm to 1000 nm; the outwardly directed surface of the cartridge (3) has, at least locally, a surface roughness between 0.5 and 5 microns, preferably between 0.75 and 2.5 microns, particularly preferably between 1 and 1.5 microns; the light source (4), which emits light at least in a wavelength region between 700 nm and 1 mm, preferably 700 nm to 1000 nm, radiates into the cartridge; the light source (4) has an emission angle $\alpha$ greater than 5°, preferably between 5° and 60°; and the light source (4) and the cartridge (3) are configured in such a way that an average path length of the light beam (L) through the cartridge (3) corresponds to between $0.1*10^5$ and $10*10^5$, preferably between $0.5*10^5$ and $7.5*10^5$, very particularly preferably between $1.0*10^5$ and $6.5*10^5$ times the wavelength of the light emitted from the light source (4).

BRIEF DESCRIPTION OF THE DRAWINGS

The present invention will hereinafter be described in conjunction with the following drawing FIGURES, wherein like numerals denote like elements, and FIG. 1 is a front and right side view of the dispensing system according to the present invention.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The dispensing system according to the present invention allows stable and secure optical communication to be achieved between the dispenser, positionable freely in the treatment space of the automatic dishwasher, and the automatic dishwasher. In particular, sufficiently diffuse optical signal radiation over a sufficiently large radiation area is realized, so that the risk of signal shadowing or signal screening, for example as a result of pots arranged over the dispenser, is reduced.

A light source that emits light at least in a wavelength region between 700 nm and 1 mm, preferably 700 nm to 1000 nm, is used in the dispensing system according to the present invention for optical communication. This wavelength region has shown itself to be particularly suitable for optical transfer inside an automatic dishwasher, in particular during operation of the automatic dishwasher when sprayed washing water is passing through the treatment space.

In addition, when a wavelength region from 700 nm to 1 mm is used, the transparent preparations stocked in the cartridge can still be configured with substantially any desired color, which increases freedom with regard to the attractive, aesthetic conformation of the preparations such as of the preparations in combination with the cartridge.

The preparations stocked in the cartridge are formulated in such a way that they exhibit a transmittance from 75% to 99% in the wavelength region between 700 nm and 1 mm, preferably 700 nm to 1000 nm. The transmittance of the preparations was ascertained in a Genesys spectrophotometer using plastic cuvettes. The measurement was performed according to DIN 5036. Sufficiently high signal strength was achieved thereby, since the signal emitted from the light source experiences only slight absorption by the preparation, so that the light intensity of the emitted signal, and thus the energy requirement for optical communication, can be kept low.

The same applies to the configuration of the walls of the cartridge. The walls of the cartridge therefore have, at least locally, a transmittance from 75% to 99% in the wavelength region between 700 nm and 1 mm, preferably 700 nm to 1000 nm. The transmittance of the cartridge walls can be determined according to DIN 5036 such as DIN 5036-3.

The transparent cartridge, couplable to the dispenser and stocking at least one transparent flowable preparation, is used as a radiating area. A sufficiently large radiating area exists when the cartridge has a width (b) to depth (t) ratio from 3:1 to 20:1, and a height (h) to depth (t) ratio from 3:1 to 20:1, and the average path length of the light beam (L) through the cartridge corresponds to between $0.1*10^5$ and $10*10^5$, preferably between $0.5*10^5$ and $7.5*10^5$, very particularly preferably between $1.0*10^5$ and $6.5*10^5$ times the wavelength of the light emitted from the light source.

In order to achieve sufficient diffusion by the surface of the cartridge walls of the light emitted from the light source, the outwardly directed surfaces of the cartridge have, at least locally, a surface roughness between 0.5 and 5 microns, preferably between 0.75 and 2.5 microns, particularly preferably between 1 and 1.5 microns. This produces sufficient scattering of the light by the cartridge that the risk of signal shadowing or signal screening is reduced. The surface roughness can be determined according to DIN 8791-4.

In order for the cartridge walls to be irradiated sufficiently homogeneously by the light source, the light source has an emission angle $\alpha$ greater than 5°, preferably between 5° and 60°. A further result of this is that that portion of the cartridge which is located at the bottom when the dispensing system is in the operating position is sufficiently irradiated, which is significant in particular when the dispensing system is covered by items being washed, for example a pot.

It is advantageous that with the dispenser and cartridge in the coupled state, the light source is positioned below the cartridge, and directed onto the bottom of the cartridge, in such a way that it radiates into the cartridge.

According to a particularly advantageous refinement of the invention, the substantially circular opening diameter on the emission side, directed into the cartridge, of the light source corresponds to between 0.25 and 0.95, preferably between 0.5 and 0.75 of the depth of the cartridge. Radiation from the lower portion of the cartridge is improved in this way as well.

In order to provide demand-compatible dispensing and optimum use of cleaning preparation, according to a further preferred embodiment of the invention it is advantageous that the cartridge comprises three chambers for stocking three preparations different from one another, the volume ratio of the three chambers being approximately 1:1:4.

It is preferred in this connection that with the dispenser and cartridge in the coupled state, the light source is arranged approximately centeredly below the largest chamber.

The light source preferably has a radiation intensity in the wavelength region from 700 nm to 1 mm, preferably 700 nm to 1000 nm, of between 2 and 100 mW/sr, preferably 10 to 60 mW/sr, particularly preferably between 15 and 50 mW/sr. It is very particularly preferred that the radiation intensity in the wavelength region between 700 nm and 1000 nm be 15 to 50 mW/sr. The result of this, on the one hand, is that a sufficient optical signal strength is achieved with the least possible energy consumption for signal transfer. This is significant in particular for a battery-operated dispensing system having a correspondingly finite quantity of energy. The radiation intensity can be determined according to DIN 5031.

The dispensing system according to the present invention is made up of the basic components of a cartridge filled with preparation, and a dispenser couplable to the cartridge, which dispenser is in turn constituted by further subassemblies such as, for example, an actuator, closure element, sensor, energy source, and/or control unit.

It is preferred that the dispensing system according to the present invention be movable. "Movable" for purposes of this Application means that the dispensing system is not connected nondetachably to an automatic dishwasher, but instead is, for example, removable from or positionable in an automatic dishwasher by the user, i.e. can be handled independently.

According to an alternative embodiment of the invention, it is also conceivable for the dispenser to be connected to an automatic dishwasher in a manner not detachable by the user, and for only the cartridge to be movable.

The elements of the dispensing system will be explained in further detail below.

Cartridge

For purposes of this Application, a "cartridge" is understood as a packaging means that is suitable for encasing or holding together at least one flowable preparation, and is couplable to a dispenser in order to deliver at least one preparation.

The cartridge is embodied in particular in such a way that it is provided for stocking a plurality of dispensable portions of the preparations stocked in it. The cartridge is preferably embodied to stock 10 to 50, particularly preferably 15 to 30, very particularly preferably 20 to 25 dispensable portions.

The cartridge preferably comprises at least three (preferably dimensionally stable) chambers for stocking preparations different from one another. It is preferred in this context that each of the chambers be embodied to stock 10 to 50, particularly preferably 15 to 30, very particularly preferably 20 to 25 dispensable portions.

It is advantageous that the cartridge comprises at least one outlet opening which is arranged in such a way that a gravity-produced preparation release from the cartridge can be produced when the dispenser is in the utilization position.

It is furthermore conceivable for the cartridge to be shaped in multi-piece fashion such that at least one chamber, preferably all the chambers, are individually removable from or insertable into the dispenser. This makes it possible, if a preparation from one chamber is consumed at a different rate, to replace an already empty chamber while the others, which may still be filled with preparation, remain in the dispenser. Targeted and demand-compatible refilling of the individual chambers with their preparations can thereby be achieved. It is additionally conceivable to embody the individual chambers in such a way that the chambers can be coupled to one another and to the dispenser in only in one specific position respective location, thereby preventing a user from connecting a chamber to the dispenser in a position not intended for said chamber. To that end, the chamber walls can in particular be shaped in such a way that they can be positively connected to one another. It is particularly advantageous, in the case of a cartridge formed from at least three chambers, to shape the cartridges such that the chambers can be connected positively to one another only in a specific defined position with respect to one another.

The chambers of a cartridge can be fastened to one another using suitable connection methods, thereby forming a container unit. The chambers can be fastened detachably or non-detachably to one another by a suitable positive, frictionally engaged, or materially attached connection. In particular, fastening can be effected by one or more of the connection types from the group of the snap-in connections, hook-and-loop connections, press connections, melt connections, adhesive connections, weld connections, solder connections, screw connections, keyed connections, clamp connections, or flip-closure connections. In particular, fastening can also be embodied by a heat-shrink sleeve, which in a heated state is pulled over all or portions of the cartridge, and in the cooled state fixedly surrounds the chambers of the cartridge.

In particular, the cartridge can also be embodied asymmetrically. It is particularly preferred to configure the asymmetry of the cartridge such that the cartridge is couplable to the dispenser only in one predefined position, thereby preventing incorrect operation by the user which would otherwise be possible.

It is particularly preferred that all preparations stocked in the cartridge be flowable, since this ensures rapid dissolution of the preparations in the washing bath of the dishwasher, with the result that these preparations achieve a rapid to immediate cleaning and/or disinfection and/or scenting effect, in particular including on the walls of the treatment space and in the washing-water conduits.

The cartridge usually has a total volumetric capacity of <5000 ml, in particular <1000 ml, preferably <500 ml, particularly preferably <250 ml, very particularly preferably <50 ml.

The cartridge encompasses a cartridge bottom which, in the service position, is directed downward in the direction of gravity, and on which at least one outlet opening arranged on the bottom side in the direction of gravity is provided preferably for each chamber. The outlet openings arranged on the bottom side are, in particular, embodied in such a way that at least one outlet opening, preferably all outlet openings, are communicatively connectable to the inlet openings of the dispenser, i.e. preparation can flow through the outlet openings out of the cartridge into the dispenser, preferably under the influence of gravity.

According to a preferable embodiment, the outlet openings of the cartridge are closed off by closure means at least when the cartridge is in the filled, unopened state. The closure means can be embodied such that they permit one-time opening of the outlet opening by destruction of the closure means. Such closure means are, for example, sealing films or closure caps.

According to a preferable embodiment of the invention, the outlet openings are each equipped with a closure that, in the state coupled to a dispenser, allows preparation to flow out of the respective chambers and, when the cartridge is in the uncoupled state, substantially prevents an outflow of preparation. A closure of this kind is configured in particular as a silicone slit valve.

In a further, preferred embodiment of the invention, the cartridge for coupling to a dispenser, positionable in the interior of a household appliance, for delivering at least one washing- and/or dishwashing-agent preparation, comprises at least one chamber for stocking at least one flowable washing- and/or dishwashing-agent preparation, the cartridge being, in the state coupled to the dispenser, protected from the entry of washing water into the chamber(s), and the cartridge encompassing at least one delivery opening, on the bottom side in the direction of gravity, for (in particular, gravity-effected) delivery of preparation out of at least one chamber, and encompassing at least one vent opening, on the bottom side in the direction of gravity, for venting at least one chamber, the vent opening being separated from the delivery opening and the vent opening being communicatively connected to at least one chamber of the cartridge.

It is particularly preferred for the cartridge to encompass at least three chambers. It is advantageous here that one vent opening and one delivery opening are respectively provided for each chamber.

It is furthermore preferred that the bottom-side vent opening be connected communicatively to a vent conduit whose end facing away from the vent opening terminates, when the cartridge coupled to the dispenser is in the delivery position, above the maximum fill level of the cartridge.

It is advantageous in this context that the vent conduit is shaped entirely or partly into or onto the walls and/or webs of the cartridge. In particular, the vent conduit can be shaped integrally into or onto the walls and/or webs of the cartridge.

The cartridge can be embodied so that it can be arranged detachably or fixedly in or on the dispenser and/or on an automatic dishwasher.

The cartridge preferably has a width (b) to depth (t) ratio from 3:1 to 20:1, and a height (h) to depth (t) ratio from 3:1 to 20:1.

In a preferred further conformation of the invention, the walls of the cartridge have, at least locally, a transmittance from 75% to 99% in the wavelength region between 700 nm and 1 mm, preferably 700 nm to 1000 nm.

It is further preferred that the outwardly directed surface of the cartridge have, at least locally, a surface roughness between 0.5 and 5 microns, preferably between 0.75 and 2.5 microns, particularly preferably between 1 and 1.5 microns. It is very particularly preferred that the entire surface of the cartridge have a surface roughness between 0.5 and 5 microns, preferably between 0.75 and 2.5 microns, particularly preferably between 1 and 1.5 microns.

It is further preferred that the cartridge comprise three chambers for stocking three preparations different from one another, where the volume ratio of the three chambers is approximately 1:1:4, and at least the surface of the largest of the three chambers has a surface roughness between 0.5 and 5 microns, preferably between 0.75 and 2.5 microns, particularly preferably between 1 and 1.5 microns, and with the dispenser and cartridge in the coupled state, the light source is positioned approximately centeredly below the largest chamber.

Dispenser

The dispensing system according to the present invention encompasses a dispenser and a multi-chamber cartridge couplable to the dispenser and containing flowable preparations. The dispenser is configured in such a way that it can dispense a plurality of preparations out of the chambers of the cartridge into the interior of a dishwasher. At least one actuator and/or at least one closure element and/or at least one control unit and/or at least one sensor and/or at least one energy source can be provided for this purpose in the dispenser.

The dispenser can be installed fixedly on a dishwashing machine.

In a preferred embodiment of the invention, the dispenser is not installed fixedly on the dishwashing machine, but instead can be positioned in freely movable fashion in a dishwashing machine by a user.

It is particularly preferred that the dispenser encompass at least one first interface that interacts corresponding interface embodied in or on a dishwasher, in such a way that a transfer of electrical energy and/or signals from the water-conveying household appliance to the dispenser and/or from the dispenser to the dishwasher is effected.

In a further embodiment of the invention, the interfaces can be embodied in such a way that a wireless transfer of electrical energy and/or of electromagnetic and/or optical signals is brought about.

It is of course possible to provide only an interface for the transfer of signals or an interface for the transfer of electrical energy, or one interface for the transfer of signals and one interface for the transfer of electrical energy, respectively, or to provide an interface that is suitable for providing a transfer of both electrical energy and signals.

An interface of this kind can be embodied in particular in such a way that a wireless transfer of electrical energy and/or electromagnetic and/or optical signals is produced.

It is particularly preferred that the interface be configured for the emission and/or reception of optical signals. It is very particularly preferred that the interface be configured for the emission and/or reception of light in the visible region.

It is particularly preferred that the interface be configured for the emission and/or reception of optical signals. It is very particularly preferred that the interface be configured for the emission and/or reception of light in the wavelength region between 700 nm and 1 mm, preferably 700 nm to 1000 nm.

The interface encompasses in particular at least one light source, in particular an LED. Particularly preferably, the interface encompasses at least two LEDs. It is also possible, according to a further preferable embodiment of the invention, to provide at least two LEDs that emit light at wavelengths that differ from one another. This makes it possible, for example, to define different signal bands on which information can be sent and/or received.

The light source preferably has an emission angle $\alpha$ greater than 5°, preferably between 5° and 60°.

In addition, according to a further preferred embodiment of the invention the radiation intensity in the wavelength region from 700 nm to 1 mm, preferably 700 nm to 1000 nm, is between 2 and 100 mW/sr, preferably 10 to 60 mW/sr, particularly preferably between 15 and 50 mW/sr.

It is particularly preferred that an optical signal be embodied as a signal pulse having a pulse duration between 1 ms and 10 seconds, preferably between 5 ms and 100 ms.

In an advantageous refinement of the invention, the dispenser can encompass, besides the light source, at least one optical receiving unit. This makes it possible, for example, for the dispenser to receive signals from an optical transmitting unit arranged in the dishwasher. This can be implemented by way of any suitable optical receiving unit, for example photocells, photomultipliers, semiconductor detectors, photodiodes, photoresistors, solar cells, phototransistors, CCD and/or CMOS image sensors. It is particularly preferred that the optical receiving unit be suitable for receiving light in the wavelength region between 700 nm and 1 mm, preferably 700 nm and 1000 nm.

A light source and an optical receiving unit, which constitute a further optical interface, can be provided in the automatic dishwasher for communication between the dispenser and the automatic dishwasher. The automatic-dishwasher-side light source and optical receiving unit are configured with reference to the emission and/or reception of optical signals in the wavelength region between 700 nm and 1 mm, preferably 700 am and 1000 nm.

The signal emitted and/or received by the interface is in particular a carrier of information, in particular a control signal or a signal that represents an operating state of the dispenser and/or of the dishwasher.

Actuator

An "actuator" for purposes of this Application is an apparatus which converts an input variable into an output variable of a different nature, and with which an object is moved or motion thereof is generated. The actuator is preferably coupled to at least one closure element in such a way that the release of preparation from at least one cartridge chamber can be brought about indirectly or directly.

The actuator can be driven by drive systems selected from the group of the gravity drives, ionic drives, electric drives, motor drives, hydraulic drives, pneumatic drives, gear drives, threaded spindle drives, ball screw drives, linear drives, roller screw drives, worm gear drives, piezoelectric drives, chain drives, and/or reaction drives.

In an embodiment of the invention, the actuator is embodied as a pump or compressor.

In a particularly preferred embodiment of the invention, the actuator is a bistable solenoid that, together with a closure element that engages into the bistable solenoid and is embodied as a plunger core, forms a pulse-controlled bistable valve. Bistable solenoids are electromechanical magnets having a linear motion direction, such that the plunger core locks in unenergized fashion in each end position.

Bistable solenoids and bistable valves are known in the existing art. A bistable valve requires one pulse for the change in valve position (open/closed), and then remains in that position until a counter-pulse is sent to the valve. The term "pulse-controlled valve" is therefore also used. An essential advantage of such pulse-controlled valves is that they consume no energy in order to remain in the valve end positions (closure position and delivery position), but require an energy pulse only in order to change the valve position; the valve end positions may thus be regarded as stable. A bistable valve remains in that switched position which most recently received a control signal.

Closure Element

A "closure element" for purposes of this Application is a component upon which the actuator acts and which, as a consequence of that action, brings about opening and/or closure of an outlet opening.

The closure element can involve, for example, valves that can be brought by the actuator into a product delivery position or a closure position.

Embodiment of the closure element and of the actuator in the form of a solenoid valve, in which the metering unit is embodied by the valve and the actuator by the electromagnetic or piezoelectric drive system of the solenoid valve, is particularly preferred. Especially when a plurality of containers, and thus of preparations to be dispensed, are used, the use of solenoid valves allows the dispensed quantity and dispensing points in time to be regulated very accurately.

Sensor

A "sensor" for purposes of this Application is a measured-variable transducer or sensing element that can sense specific physical or chemical properties and/or the material nature of its environment, qualitatively or, as a measured variable, quantitatively.

The dispensing system preferably comprises at least one sensor that is suitable for sensing a temperature. The temperature sensor is embodied in particular for sensing a water temperature.

It is further preferred that the dispensing system encompass a sensor for sensing conductivity, with which, in particular, the presence, entry, and/or spraying of water in an automatic dishwasher is/are sensed.

In order to avoid polarization at the contacts of the conductivity sensor when a direct current source is used, which impairs sensor accuracy, it is advantageous to carry out two successive resistance measurements at the conductivity sensor with different polarities in each case, i.e. with reversal of the positive and negative poles, so that no charge excesses can form at the contacts.

A sensor can be selected, in particular, from the group of the timers, temperature sensors, infrared sensors, brightness sensors, motion sensors, elongation sensors, rotation speed sensors, proximity sensors, flow sensors, color sensors, gas sensors, vibration sensors, pressure sensors, conductivity sensors, turbidity sensors, acoustic pressure sensors, "lab on a chip" sensors, force sensors, acceleration sensors, tilt sensors, pH sensors, moisture sensors, magnetic field sensors, RFID sensors, Hall sensors, biochips, odor sensors, hydrogen sulfide sensors, position sensors, gyroscopic sensors, optical, electrical, and/or mechanical displacement sensors, and/or MEMS sensors.

It is particularly preferred that at least two sensors for measuring parameters different from one another be provided in and/or on the dispensing system, very particularly preferably one sensor being a conductivity sensor and a further sensor being a temperature sensor.

The sensors are in particular adjusted to detect the beginning, progress, and end of a dishwashing program in an automatic dishwasher. By way of non-exhaustive example, the sensor combinations listed in the table below can be used for this purpose:

| Sensor 1 | Sensor 2 | Sensor 3 | Sensor 4 |
|---|---|---|---|
| Conductivity sensor | | | |
| Temperature sensor | | | |
| Conductivity sensor | Temperature sensor | | |
| Conductivity sensor | Temperature sensor | Acoustic sensor | |
| Conductivity sensor | Temperature sensor | Acoustic sensor | Turbidity sensor |
| Acoustic sensor | Temperature sensor | | |
| Acoustic sensor | Conductivity sensor | | |
| Vibration sensor | Conductivity sensor | | |
| Vibration sensor | Temperature sensor | | |

By means of the conductivity sensor it is possible to detect, for example, whether the conductivity sensor is wetted by water, thereby allowing a determination as to whether, for example, water is present or is being sprayed in the automatic dishwasher.

Treatment programs in dishwashers, for example dishwashing programs, as a rule exhibit a characteristic temperature profile, which is determined inter alia by the heating of the washing water and which is detectable using a temperature sensor.

By means of a vibration sensor it is possible, for example, to detect natural oscillations especially the resonance of an automatic dishwasher with a rotating spray arm. It is thus conceivable, for example, to detect the beginning and/or end of a dishwashing program by means of a vibration sensor.

A turbidity sensor can also be provided to determine the degree of soiling of the items to be cleaned in the automatic dishwasher. This also allows, for example, selection in the dispensing system of a dispensing program appropriate for the identified soiling situation.

It is also conceivable to detect the progress of a treatment program of an automatic dishwasher with the aid of at least one acoustic sensor, by the fact that specific acoustic and/or vibration emissions are detected, for example, when water is being pumped in or out.

It is of course possible for one skilled in the art to use any desired suitable combinations of multiple sensors in order to achieve monitoring of a treatment program of a dishwasher.

The data line between the sensor and control unit can be realized by way of an electrically conductive cable, or wirelessly. It is also conceivable in principle for at least one sensor to be positioned or positionable outside the dispensing system in the interior of a dishwasher, for example in the treatment space, in or in the washing drum, and/or in or on the bleach dispenser, and for a data line to be embodied, in particular wirelessly, for transmission of the measured data from the sensor to the dispensing system. A wirelessly embodied data line is embodied in particular by the transfer of electromagnetic waves or light. It is preferred to embody a wireless data line in accordance with accepted standards such as, for example, Bluetooth, IrDA, IEEE 802, GSM, UMTS, etc.

Control Unit

A "control unit" for purposes of this Application is an apparatus that is suitable for influencing the transportation of material, energy, and/or information. For this purpose, the control unit influences at least one actuator with the aid of information, in particular measurement signals of the sensor unit, which it processes for purposes of the control objective. In particular, at least one sensor is connected to the control unit, it being particularly preferred that the sensor direct to the control unit a signal that represents the presence of water in the dishwasher and/or operation of the dishwasher.

The control unit can be in particular a programmable microprocessor. In a particularly preferred embodiment of the invention, a plurality of dispensing programs are stored on the microprocessor.

In a preferred embodiment, the control unit has no connection to the household appliance controller that is possible present. No data, in particular electrical, optical, or electromagnetic signals, are therefore exchanged directly between the control unit and the household appliance controller.

In an alternative embodiment of the invention, the control unit is coupled to the household appliance controller that is present. This coupling is preferably embodied wirelessly. It is possible, for example, to position a transmitter on or in an automatic dishwasher, by preference on or at the dispensing chamber recessed into the door of the automatic dishwasher, which transmitter wirelessly transfers a signal to the dispensing unit when the household appliance controller brings about dispensing, for example, of a cleaning agent out of the dispensing chamber, or of rinse aid.

The delivery of preparations out of the dispenser can occur, under the control of the control unit, sequentially or simultaneously.

It is particularly preferred to dispense a plurality of preparations sequentially in a dishwashing program.

Energy Source

An "energy source" is understood for purposes of this Application as a component of the dispensing system which is useful for making available energy suitable for operation of the dispensing system in particular, the dispenser. The energy source is preferably configured in such a way that the dispensing system is autonomous.

The energy source preferably makes available electrical energy. The energy source can be, for example, a battery, a rechargeable battery, a power supply, solar cells, or the like.

It is particularly advantageous to embody the energy source exchangeably, for example in the form of a replaceable battery.

A battery can be selected, for example, from the group of the alkaline manganese batteries, zinc-carbon batteries, nickel-oxyhydroxide batteries, lithium batteries, lithium-iron sulfide batteries, zinc-air batteries, zinc chloride batteries, mercury oxide-zinc batteries, and/or silver oxide-zinc batteries.

Suitable as rechargeable batteries are, for example, lead batteries (lead dioxide/lead), nickel-cadmium batteries, nickel-metal hydride batteries, lithium ion batteries, lithium polymer batteries, alkaline manganese rechargeable batteries, silver-zinc rechargeable batteries, nickel hydride batteries, zinc-bromine batteries, sodium-nickel chloride batteries, and/or nickel-iron batteries.

The rechargeable battery can be configured in particular so that it can be recharged by induction.

The energy source is dimensioned in such a way that the dispenser can execute approximately 1000 dispensing cycles before the energy source is depleted. It is particularly preferred that the energy source be capable of executing between 1 and 1000 dispensing cycles, very particularly preferably between 10 and 500, more preferably between 100 and 300, before the energy source is depleted.

Preparations

A flowable preparation according to the present invention has a transmittance from 75% to 99% in the wavelength region between 700 nm and 1 mm, preferably 700 nm and 1000 nm.

It is preferred to use a plurality of preparations that are stocked in chambers of the cartridge that are separated from one another. According to the present invention, the preparations in the cartridge chambers are preferably different from one another.

According to a preferred embodiment, the preparations stocked in the cartridge chambers are flowable; they preferably have a viscosity between 10 and 10,000 mPas at a shear rate of 30 $s^{-1}$ and a temperature of 25° C. the viscosity of the preparations can be measured with usual standard methods (for example, Brookfield RVD-VII viscosimeter at 20 rpm and 20° C., spindle 3).

Exemplifying Embodiment

An exemplifying embodiment of the dispensing system positionable in the interior of an automatic dishwasher is depicted in FIG. 1 in a front view and a side view. Dispensing system 1 is made up of dispenser 2 and a cartridge 3 couplable to dispenser 1. Arranged in dispenser 2 are the control unit, a battery, a conductivity sensor and a temperature sensor, an actuator, and a closure element (not depicted), which interact in such a way that when a predefined temperature exists at the temperature sensor and a predefined conductivity exists at the conductivity sensor, representing the presence of water, the battery-operated control unit energizes a battery-operated actuator so that the actuator shifts the closure element into a delivery position and a preparation is delivered out of the cartridge into the treatment space of the automatic dishwasher.

Dispenser 2 has a width b and a depth t, where the width (b) to depth (t) ratio is from 3:1 to 20:1.

Cartridge 3 has a width b and a depth t, where the width (b) to depth (t) ratio is from 3:1 to 20:1. As may be gathered from FIG. 1, the width (b) to depth (t) ratio of the dispenser and cartridge are approximately the same in the exemplifying embodiment shown.

As a result of the asymmetrical conformation, easily seen in FIG. 1, of the cartridge, the cartridge has a first height h1 and a second height h2. This results in a height (h) to depth (t) ratio for the cartridge from 3:1 to 20:1, the shorter height h2 being employed to calculate the ratio.

The outwardly directed surface of cartridge 3 has, at least locally, a surface roughness between 0.5 and 5 microns, preferably between 0.75 and 2.5 microns, particularly preferably between 1 and 1.5 microns; it is preferred, as in the present exemplifying embodiment, that the entire outwardly directed surface of cartridge 3 have a surface roughness between 0.5 and 5 microns, preferably between 0.75 and 2.5 microns, particularly preferably between 1 and 1.5 microns.

The cartridge comprises three chambers 5*a*, 5*b*, 5*c* that are filled with flowable preparations A, B, and C. The volume ratio of the three chambers is approximately 1:1:4. Flowable preparations A, B, C have a transmittance from 75% to 99% in the wavelength region between 700 nm and 1 mm, preferably 700 nm to 1000 nm. The walls of cartridge 3 have a transmittance from 75% to 99% in the wavelength region between 700 nm and 1 mm, preferably 700 nm to 1000 nm.

In the exemplifying embodiment shown, an enzyme-containing preparation is stocked in first chamber 5*a*, a rinse aid preparation in second chamber 5*b*, and an alkaline cleaning preparation in the third, largest chamber 5*c*. Preparations A, B, C stocked in the three chambers 5*a*, 5*b, c* have light absorption spectra in the wavelength region between 350 and 699 nm that differ from one another.

A light source 4 in the form of an LED is arranged in the top of dispenser 2. With dispenser 2 and cartridge 3 in the coupled state, light source 4 is positioned below cartridge 3, and is directed onto the bottom of cartridge 3, in such a way that it radiates into cartridge 3, as symbolized in FIG. 1 by light beam L that is indicated. In the exemplifying embodiment shown, with dispenser 2 and cartridge 3 in the coupled state, light source 4 is arranged approximately centeredly below the largest chamber 5*c*.

Light source 4 has an emission angle or beam angle $\alpha$ greater than 5°, preferably between 5° and 60.

Light source 4 and cartridge 3 are configured in such a way that the average path length of light beam L through cartridge 3 corresponds to between $0.1*10^5$ and $10*10^5$, preferably between $0.5*10^5$ and $7.5*10^5$, very particularly preferably between $1.0*10^5$ and $6.5*10^5$ times the wavelength of the light emitted from light source 4.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A dispensing system (1) for delivering at least one cleaning-agent preparation (A, B, C) into the interior of an automatic dishwasher, encompassing a dispenser (2) having a light source (4), and a cartridge (3) couplable to the dispenser (2), in which cartridge at least one flowable preparation (A, B, C) is stocked, wherein a. the cartridge (3) has a width (b) to depth (t) ratio from 3:1 to 20:1;

b. the cartridge (3) has a height (h) to depth (t) ratio from 3:1 to 20:1;

c. the walls of the cartridge (3) have a transmittance from 75% to 99% in the wavelength region between 700 nm and 1 mm;

d. the flowable preparation (A, B, C) has a transmittance from 75% to 99% in the wavelength region between 700 nm and 1 mm;

e. the outwardly directed surface of the cartridge (3) has a surface roughness between 0.5 and 5 microns;

f. the light source (4), which emits light at least in a wavelength region between 700 nm and 1 mm into the cartridge;

g. the light source (4) has an emission angle $\alpha$ greater than 5°, and h. the light source (4) and the cartridge (3) are configured in such a way that an average path length of the light beam (L) through the cartridge (3) corresponds to between $0.1*10^5$ and $10*10^5$ times the wavelength of the light emitted from the light source (4).

2. The dispensing system according to claim 1, wherein with the dispenser (2) and cartridge (3) in the coupled state, the light source is positioned below the cartridge (3), and is directed onto the bottom of the cartridge (3), in such a way that it radiates into the cartridge (3).

3. The dispensing system according to claim 1, wherein the substantially circular opening diameter on the emission side, directed into the cartridge (3), of the light source (4) corresponds to between 0.25 and 0.95 of the depth (t) of the cartridge (3).

4. The dispensing system according to claim 1, wherein the radiation intensity of the light source is in the wavelength region from 700 nm to 1 mm and is between 2 and 100 mW/sr.

5. The dispensing system according to claim 1, wherein the cartridge (3) comprises a first, second and third chamber (5*a*, 5*b*, 5*c*) for stocking three preparations (A, B, C) different from one another, wherein the volume ratio of the three chambers, first:second:third, is approximately 1:1:4.

6. The dispensing system according to claim 5, wherein with the dispenser (2) and cartridge (3) in the coupled state, the light source (4) is arranged approximately centeredly below the largest chamber (5*c*).

7. The dispensing system according to claim 5, wherein an enzyme-containing preparation is present in the first chamber (5*a*), a rinse aid preparation in the second chamber (5*b*), and an alkaline cleaning preparation in the third chamber (5*c*).

8. The dispensing system according to claim 5, wherein the preparations (A, B, C) stocked in the three chambers (5*a*, 5*b*, 5*c*) have light absorption spectra in the wavelength region between 350 and 699 nm that differ from one another.

* * * * *